US007874251B1

(12) United States Patent
Fu

(10) Patent No.: US 7,874,251 B1
(45) Date of Patent: Jan. 25, 2011

(54) CAVITY-RUNNING PROJECTILE HAVING A TELESCOPING NOSE

(75) Inventor: Jyun-Horng Fu, Linden Creek Ct., VA (US)

(73) Assignee: Lockheed Martin Corporation, Bethesda, MD (US)

( * ) Notice: Subject to any disclaimer, the term of this patent is extended or adjusted under 35 U.S.C. 154(b) by 320 days.

(21) Appl. No.: 12/102,784

(22) Filed: Apr. 14, 2008

Related U.S. Application Data

(60) Provisional application No. 60/911,419, filed on Apr. 12, 2007.

(51) Int. Cl.
*F42B 15/22* (2006.01)

(52) U.S. Cl. ..... 102/399; 114/20.1

(58) Field of Classification Search ..... 102/398, 102/399, 517, 519; 114/20.1
See application file for complete search history.

(56) References Cited

U.S. PATENT DOCUMENTS 1,371,207 A * 3/1921 Wilkinson ..... 102/398
3,041,992 A * 7/1962 Lee ..... 114/312
3,256,816 A * 6/1966 Pilcher, II ..... 102/374
3,282,216 A * 11/1966 Calfee et al. ..... 244/159.1
3,677,179 A * 7/1972 Potteiger et al. ..... 102/473
3,842,741 A * 10/1974 Brothers et al. ..... 102/490
4,687,455 A * 8/1987 Sculatti ..... 446/52
4,770,369 A * 9/1988 Flock et al. ..... 244/3.1
5,464,172 A * 11/1995 Jensen et al. ..... 244/3.1
5,494,239 A * 2/1996 Giacomel ..... 244/3.1
6,388,184 B1 * 5/2002 Glenning ..... 114/22
6,739,266 B1 * 5/2004 Castano et al. ..... 102/399
7,779,759 B2 * 8/2010 Paulic et al. ..... 102/399

* cited by examiner

*Primary Examiner*—Bret Hayes
(74) *Attorney, Agent, or Firm*—DeMont & Breyer, LLC

(57) ABSTRACT

A projectile having a cavity-running mode is provided with a mechanism for changing the diameter of its nose. Based on changed conditions, the diameter of the nose can be actively reduced or increased, as required, to maintain a desired value for the nose-to-body ratio of the projectile.

15 Claims, 3 Drawing Sheets

CAVITY-RUNNING PROJECTILE HAVING A TELESCOPING NOSE

STATEMENT OF RELATED CASES

This case claims priority of the following U.S. Provisional Patent Applications: Ser. No. 60/911,419 filed on Apr. 12, 2007, Ser. No. 60/992,025 filed on Dec. 3, 2007, and Ser. No. 61/033,418 filed on Mar. 3, 2008. All of these Provisional Patent Applications are incorporated by reference herein.

FIELD OF THE INVENTION

The present invention relates to underwater projectiles having a supercavitating running mode.

BACKGROUND OF THE INVENTION

Research and development is currently underway to produce underwater projectiles that travel at very high speeds using the phenomenon of "supercavitation." A progenitor of such projectiles is the "Shkval," which is a rocket-propelled torpedo that was developed by Russia and achieves a velocity of 250 knots (288 mph).

A supercavitating projectile's main features are a specially shaped nose and a streamlined, hydrodynamic, and aerodynamic body. The nose has a blunt leading surface that is referred to as a "cavitator." When the projectile travels through water at speeds in excess of about one hundred miles per hour, the cavitator deflects water outward so fast that the water flow separates and detaches from the surface of the projectile. Since water pressure takes time to collapse the wall of the resulting cavity, the nose opens an extended bubble of water vapor.

Given sufficient speed, the cavity can extend to envelop the entire projectile except the nose. Once engulfed by the bubble, the drag experienced by the projectile is significantly reduced. As a consequence, a projectile moving in the cavity ("cavity-running") can travel at far greater speeds for a given amount of thrust than a projectile that is moving in a conventional manner through water. A cavity-running projectile quite literally "flies" through the surrounding gas. In the absence of sustaining propulsion, the projectile loses supercavitation and eventually stalls due to drag. A secondary benefit of cavity running is that the motion stability of the projectile is enhanced.

SUMMARY OF THE INVENTION

The present invention provides a way to increase the distance over which a projectile is capable of sustaining a cavity-running mode.

There is an "optimum" value for the nose-to-body ratio of a projectile when operating underwater in a cavity-running mode. This optimum value is a function, primarily, of the prevailing pressure (i.e., depth and water density) and velocity. Therefore, as long as the projectile maintains a horizontal trajectory and constant speed, the optimum value for this ratio does not change. Once the projectile deviates from a horizontal path, the optimal value will, of course, change.

It has been recognized by the inventor that it would be advantageous to be able to actively and dynamically adjust the nose-to-body ratio to maintain an optimum value. Doing so maximizes the distance for which the projectile remains in the cavity-running mode. And that maximizes the speed of the projectile and distance that it can ultimately travel.

In accordance with the illustrative embodiment, a projectile having a cavity-running mode is provided with velocity and/or depth/pressure sensors and a means for changing the diameter of its nose. Based on changes in conditions, as measured by the sensors, the diameter of the nose can be actively reduced or increased, as required, to maintain a diameter that best satisfies the optimum value for the nose-to-body diameter ratio.

In some embodiments, the forward-most portion of the nose is configured as a plurality of nested, right-circular cylindrical shells or segments. By withdrawing or adding segments in the manner of the movement of a "spy-glass" or telescoping antennae, the diameter of nose (i.e., cavitator) is changed.

The means for changing nose diameter can be suitably implemented as a MEMS device configured as an actuator and coupled to a drive train, wherein the drive train couples to the various segments of the forward portion of the nose. In conjunction with the present disclosure, those skilled in the art will be able to design and build such a mechanism.

In some other embodiments, a simplified (i.e., less "intelligent") version of an actuator, such as a series of spring latches, can be used to adjust the diameter of the nose by sequentially releasing segments of the nose, etc.

DETAILED DESCRIPTION

Figure 1:
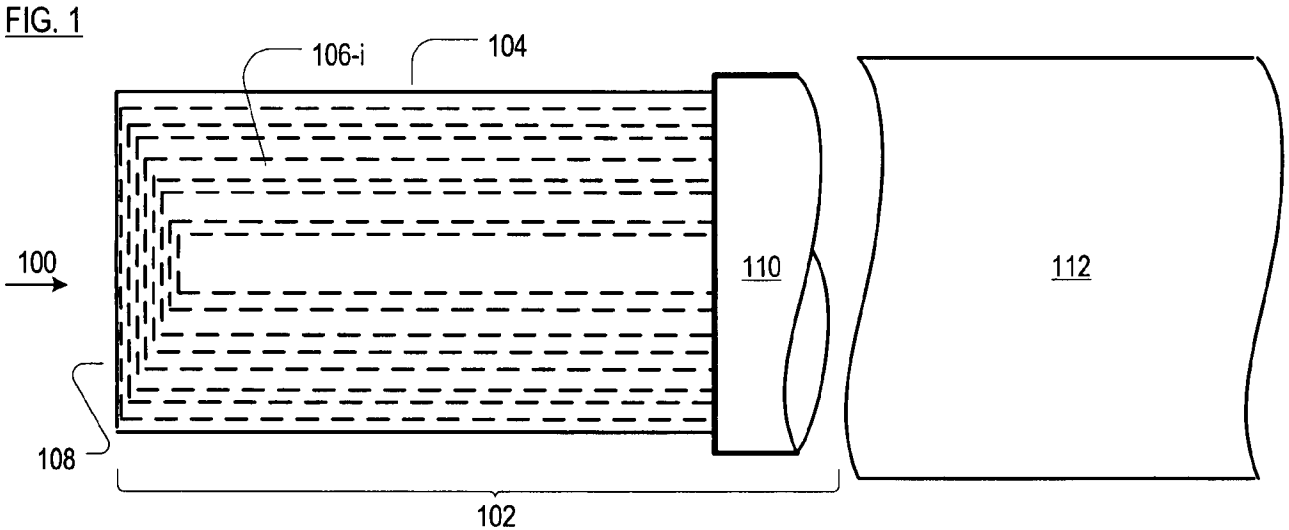
FIG. 1 depicts a schematic of a projectile in accordance with the illustrative embodiment, wherein the cavitator portion of the nose comprises a plurality of nested cylindrical segments, and wherein the cavitator section is shown at maximum diameter.

FIG. 1 depicts projectile 100 in accordance with the illustrative embodiment. The projectile includes nose 102 and body 112 (both shown in partial section). Nose 102 comprises forward-most section or cavitator 104.

Forward face 108 of nose 102 is blunt so that when projectile 100 achieves suitable velocity, a cavity-running mode of operation is created. In particular, the blunt face 108 pushes aside water as it advances. When the hydrodynamic pressure of water that is pushed aside overcomes the ambient static pressure, the water vaporizes. The vaporized water forms air bubbles, which coalesce to form a "cavity" in the water. If enough bubbles are formed, the cavity will be large enough to completely engulf the projectile (with the exception of the blunt tip of the nose). Since the projectile is then surrounded by air, rather than water, hydrodynamic drag is substantially reduced.

For the foregoing reason, forward face 108 and/or segment 104 is therefore referred to as a "cavitator." For the purposes of this specification, including the appended claims, reference to "the diameter of the nose" means the diameter of cavitator 104.

As depicted in FIG. 1, cavitator 104 comprises one or more nesting segments 106-*i*, i=1, n (collectively referenced as "segments 106"). In the illustrative embodiment, i=9; that is, there are nine segments 106.

To permit nesting, each segment 106-*i* has a diameter that is different than every other segment 106-*i*. In the illustrative embodiment, the nesting segments are cylindrical; however, in other embodiments, they are right-circular conical segments. Note that in the illustrative embodiment, forward face 108 is a substantially flat, substantially continuous surface. As such, and as will become clearer in conjunction with FIGS. 4 and 5, the forward face of all segments 106-*i* in FIG. 1 are co-planar or flush with one another (although this is not depicted in FIG. 1 for pedagogical purposes).

Figure 2:
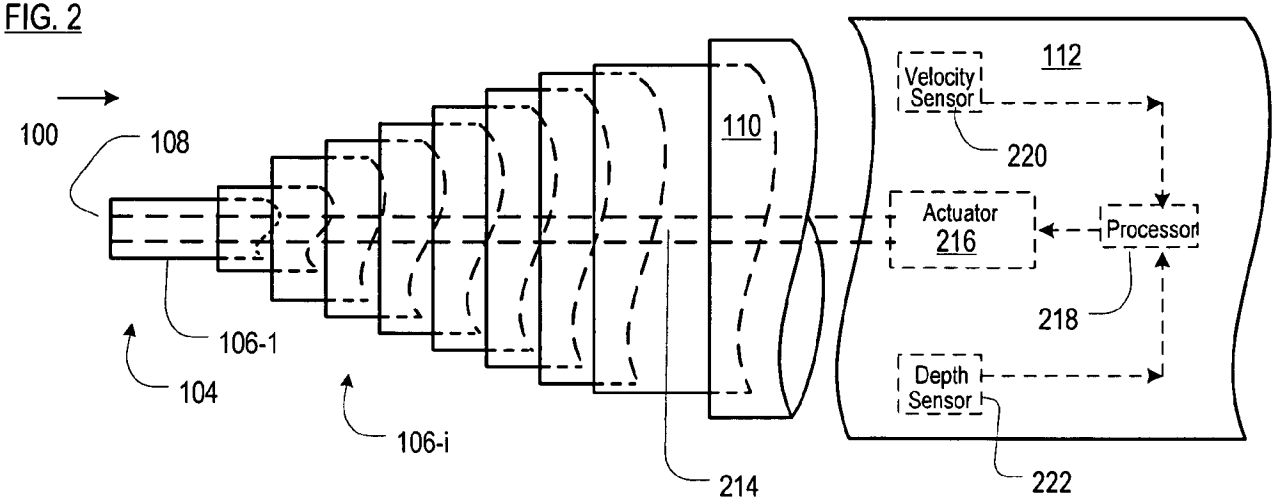
FIG. 2 depicts the projectile of FIG. 1 wherein the nested segments of the cavitator are partially retracted, and wherein the cavitator section is shown at a minimum diameter.

As depicted in FIG. 2, each segment 106-*i* is independently movable via the operation of actuator 216 and drive line 214, to which the segments are operatively coupled. FIG. 2 depicts the segments 106-2 through 106-9 retracted to a successively greater extent, such that segment 106-1 becomes the forward most segment and, in fact, defines cavitator 104. This has the effect of reducing the diameter of nose 102.

Thus, in the state that is depicted in FIG. 1, projectile 100 has its maximum nose diameter wherein all segments 106 are fully extended. In such a state, cavitator 104 comprises all segments 106. By contrast, in the state depicted in FIG. 2, projectile 100 has its minimum nose diameter, and cavitator 104 comprises only segment 106-1.

Figure 3:
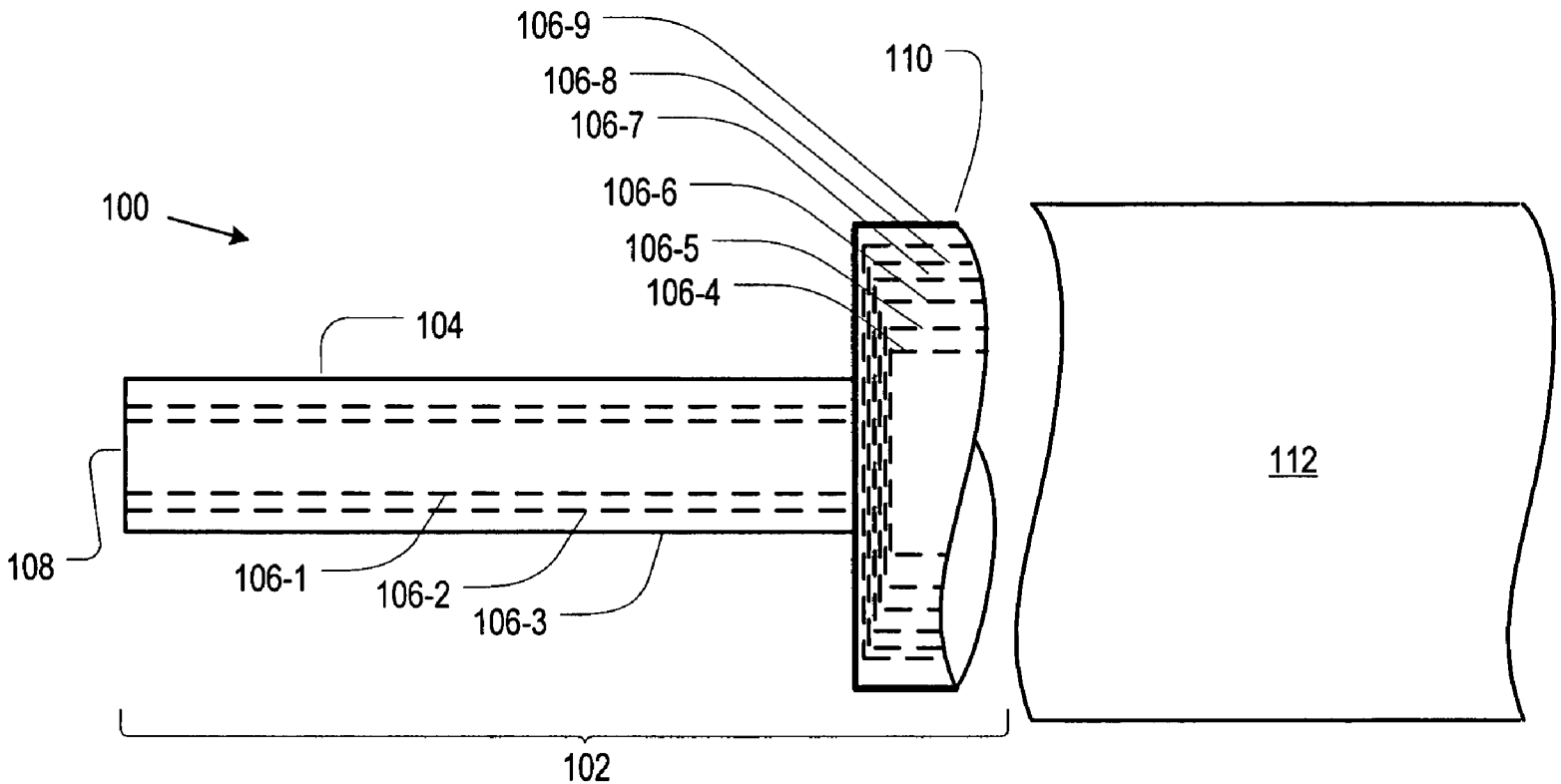
FIG. 3 depicts the projectile of FIG. 1 wherein some of the segments of the cavitator are retracted such that the cavitator section has an intermediate diameter.

FIG. 3 depicts and embodiment in which segments 106-4 through 106-9 are retracted so that cavitator 104 is defined by segments 106-1, 106-2, and 106-3. In this state, projectile 100 has a nose diameter that is intermediate between that shown in FIGS. 1 and 2.

Figure 4:
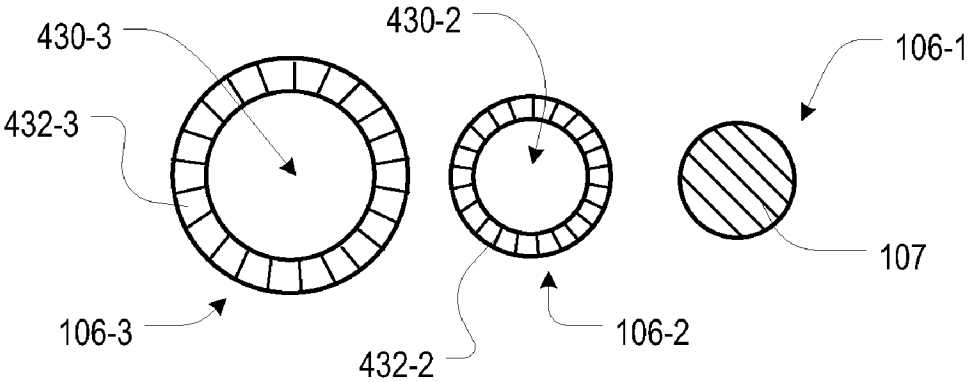
FIG. 4 depicts an end-on view of several of the segments of the cavitator, wherein the segments are separated from one another for pedagogical purposes.
Figure 5:
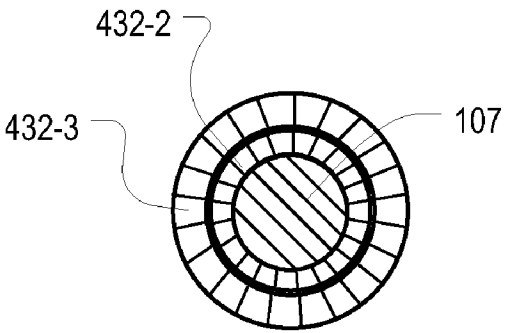
FIG. 5 depicts an end-on view of the segments of FIG. 4 when the segments are in their nominal nested arrangement. This Figure illustrates that the forward surface of the cavitator is a continuous surface.

As previously noted, forward surface 108 of cavitator 104 is substantially continuous. One way to accomplish this is depicted in FIGS. 4 and 5. FIG. 4 depicts front views of segments 106-1, 106-2, and 106-3. The segments are separated from one another in the FIG. 4 for explanatory purposes. Segment 106-1, which has the smallest diameter, is "solid," or otherwise has a continuous forward face 107. Segment 106-2, which is the next largest segment after 106-1, has an open region 430-2 that receives face 107 of segment 106-1. Segment 106-2 also includes a solid-surface marginal region 432-2 that represents the increment in diameter beyond segment 106-1. Likewise, next-largest segment 106-3 has an open region 430-3 for receiving the surface that is collectively defined by marginal region 432-2 and face 107. Segment 106-3 also includes marginal region 432-3 that represents the increase in diameter over segment 106-2.

FIG. 5 depicts these three segments end-on in the normal nested arrangement. In the state depicted in FIG. 5, face 107 (of segment 106-1), marginal region 432-2 (of segment 106-2), and marginal region 432-3 (of segment 106-3) are flush, defining face 108. This is representative of a "front view' of FIG. 3. It is face 108 that "sees" water and creates the supercavitation phenomena, as previously described.

All other segments are configured in the manner of segments 106-2 and 106-3 to enable nesting and to provide a "solid" or continuous forward face 108 to cavitator 104, regardless of how many segments 106-*i* define the cavitator.

Returning to FIG. 2, the telescoping operation of nose 102 is controlled via processor 218, based on input from one or more sensors. In some embodiments, projectile 100 includes velocity sensor 220. In some other embodiments, projectile 100 includes depth (or pressure) sensor 222. In yet some further embodiments, projectile 100 includes both velocity sensor 220 and depth (pressure) sensor 222. As described further below, processor 218 uses velocity and/or depth measurements obtained by the sensors to calculate an "optimal" nose-to-body diameter ratio for those conditions.

The nose-to-body diameter ratio can be "optimized" on a variety of different bases. For example, it can be optimized based on providing the maximum range. Or it can be optimized based on minimizing the amount of thrust required to maintain supercavitation operation (i.e., the cavity-running mode). Those skilled in the art will recognize that additional bases for optimization exist.

For example, in some embodiments, processor 112 calculates an optimal nose diameter (i.e., cavitator diameter) using the expression:

$$D_n^* = D_b/([0.550783 \times V_o] + 0.157122) \quad [1]$$

Wherein:

$D_n^*$=optimal nose diameter;

$D_b$=body diameter; and $V_o$=velocity of the projectile.

The foregoing equation was obtained by curve fitting solutions of $D_n^*$ against different values of $V_o$, wherein $V_o$ is the initial velocity of a projectile normalized to the characteristic velocity $V_c$ at the depth of the (horizontally moving) projectile. $V_c=(2P/\rho_{water})$, where P is water, the static drag and $\rho_{water}$ is the density of water at the relevant temperature. Interpreting $V_o$ as the current velocity of projectile (as if the projectile was just launched at the current depth), the instantaneous optimal nose diameter $D_n^*$ is given by expression [1].

Since body diameter $D_b$ is fixed and known, and the velocity is obtained from sensor 114, a new nose diameter is readily calculated.

Processor 218 determines which one or more segments 106-*i* should be moved to achieve the new "optimal" nose-to-body diameter ratio. Signals indicative of which segment(s) to move and by how much are generated by processor 218 and transmitted to a driver (not depicted). The driver generates signals appropriate for controlling actuator 216 to extend or withdraw drive line 214, as appropriate.

It will be appreciated that a variety of "nose" configurations can be adopted for any specified nose diameter. In particular, the nose diameter is determined by the diameter of cavitator 104. But that does not dictate the extent to segments 106-*i* that are not part of the cavitator 104 must be retracted. For example, FIG. 2 depicts a minimum nose diameter wherein only segment 106-1 is fully extended to serve as cavitator 104, while the remaining segments are incrementally retracted. In other states, the remaining segments can be retracted to a different extent.

The extent to which the remaining segments are retracted will be dependent upon aerodynamic considerations, among other factors, and is within the competency of those skilled in the art.

Alternate expressions are available for determining optimal nose diameter. For example, for a cavity-running projectile that is under thrust, F, the optimal nose diameter (the diameter that sustains a cavity-running mode for the available thrust and the operating depth) is given by:

$$D_N^* = 0.29 \times (F/(\rho_{water} gH + ATM))^{0.5}, \quad [2]$$

wherein:

F is the applied thrust;

H is the depth of the projectile under water;

ATM is the water pressure bearing on the projectile;

$\rho_{water}$ is the density of the water at the relevant temperature; and g is the acceleration due to gravity.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A projectile capable of operating in a cavity-running mode, the projectile comprising:

a body;

a nose that depends from the body, wherein the nose comprises a plurality of nesting segments, one or more of which serve as a cavitator, wherein each segment has a diameter that is different from a diameter of other of the segments, and wherein the nose has a diameter that is defined by segments that serve as the cavitator;

a drive line, wherein the segments are operatively coupled to the drive line;

an actuator, wherein the actuator is operatively coupled to the drive line and is capable of moving the drive line in a manner that causes one or more of the segments to retract or extend from an initial position;

at least one sensor, wherein the at least one sensor obtains data selected from the group consisting of data that is related to the velocity of the projectile and data that is related to the depth of the projectile under water, and further wherein the at least one sensor generates a first signal indicative of the data; and a processor, wherein the processor receives the first signal and, based thereon, determines a desired overall nose diameter and generates a second signal that directs the actuator to move the drive line to achieve the desired overall nose diameter by changing the segments that serve as the cavitator.

2. The projectile of claim 1 wherein the at least one sensor is a velocity sensor.

3. The projectile of claim 1 wherein the at least one sensor is a depth sensor.

4. The projectile of claim 1 wherein the at least one sensor is a pressure sensor.

5. A projectile comprising:

a nose, wherein the nose comprises a cavitator, and wherein the cavitator comprises a plurality of nested, movable segments, and wherein the segments have a different diameter from one another;

a mechanism for moving the segments, wherein the mechanism is capable of withdrawing the segments from the cavitator and adding segments to the cavitator, wherein the diameter of the cavitator varies as a state of the segments as withdrawn from or added to the cavitator; and a processor, wherein the processor receives sensor data that enables it to calculate a desired diameter for the cavitator.

6. The projectile of claim 5 wherein the processor generates a signal that causes the mechanism to move the segments to achieve the desired diameter.

7. The projectile of claim 5 wherein the segments have a cylindrical shape.

8. The projectile of claim 7 wherein the segments have a conical shape.

9. The projectile of claim 5 wherein the processor determines which one or more of the segments to move to achieve the desired diameter.

10. The projectile of claim 5 further comprising a first sensor.

11. The projectile of claim 10 wherein the first sensor is a velocity sensor.

12. The projectile of claim 10 wherein the first sensor is a depth sensor.

13. The projectile of claim 11 comprising a second sensor, wherein the second sensor is a depth sensor.

14. A method for operating a projectile under water, wherein the method comprises:

operating the projectile in a cavity-running mode;

sensing a velocity of the projectile;

calculating a desired nose-to-body diameter ratio for the projectile; and altering a diameter of a nose of the projectile to achieve the desired nose-to-body diameter ratio.

15. The method of claim 14 wherein the nose comprises a plurality of segments each of which has a diameter that is different from all other segments, and wherein the operation of altering the diameter of the nose further comprises retracting or extending the segments.

* * * * *